US006371173B1

(12) United States Patent
Liebmann, Jr.

(10) Patent No.: US 6,371,173 B1
(45) Date of Patent: Apr. 16, 2002

(54) THREADED CONNECTING ASSEMBLY

(75) Inventor: George W. Liebmann, Jr., Santa Fe, NM (US)

(73) Assignee: PermaFresh Corporation, Hanover, NH (US)

( * ) Notice: Subject to any disclaimer, the term of this patent is extended or adjusted under 35 U.S.C. 154(b) by 0 days.

(21) Appl. No.: 09/599,115

(22) Filed: Jun. 22, 2000

(51) Int. Cl.[7] ..... B65B 1/00

(52) U.S. Cl. ..... 141/19; 141/329; 141/384; 222/5; 222/81; 222/83

(58) Field of Search ..... 141/3, 19, 329, 141/330, 383, 384; 222/3, 5, 81, 83, 83.5, 88

(56) References Cited

U.S. PATENT DOCUMENTS 2,343,276 A * 3/1944 Carlson ..... 141/329
2,679,140 A * 5/1954 Burchett ..... 141/19
2,717,720 A * 9/1955 Nissen ..... 141/19
2,921,711 A * 1/1960 Mack ..... 222/5
3,809,288 A * 4/1974 Mackal ..... 222/5
5,472,025 A * 12/1995 Conrad et al ..... 141/384
5,632,315 A * 5/1997 Rose ..... 141/329
5,725,034 A * 3/1998 Fry et al. ..... 141/384
6,142,195 A * 11/2000 Lin ..... 141/383

OTHER PUBLICATIONS

Machine Elements, pp. 8–9 to 8–24, by Eugene A. Avallone, from Marks' Standard Handbook for Mechanical Engineers, edited by Baumeister et al., McGraw–Hill, 1978.*

* cited by examiner

*Primary Examiner*—J. Casimer Jacyna
(74) *Attorney, Agent, or Firm*—Watov & Kipnes, P.C.

(57) ABSTRACT

A threaded connecting assembly includes a first threaded connecting member having a body portion, an end portion, a bore extending axially from the end portion enabling the passage of a fluid through the body portion, and a plurality of spaced apart three sided threads defining grooves therebetween projecting along an exterior surface of the body portion at the end portion, and a cap member having a plurality of complementary three sided threads adapted to mate with the plurality of the three sided threads of the first threaded connecting member by seating in the grooves, and an opening configured for engagement with the bore of the first threaded connecting member to provide a passageway for the flow of the fluid therebetween.

8 Claims, 7 Drawing Sheets

THREADED CONNECTING ASSEMBLY

FIELD OF THE INVENTION

The present invention relates to a threaded connecting assembly, more particularly to a threaded connecting assembly for forming a fluid connection between two fluid conduits in a manner providing high pressure durability, wear resistance, and rapid sealing therebetween.

BACKGROUND OF THE INVENTION

Compressed fluids including gas, liquid and combinations thereof, are widely used throughout the food industry. Carbon dioxide gas and inert gases such as argon, helium, and nitrogen are extensively utilized for carbonation and food preservation, for example. Such food processing operations typically employ a fluid dispensing apparatus, a fluid source for supplying pressurized fluid, and a means for fluidly connecting the fluid source to the fluid dispensing apparatus. The fluid source is usually in the form of a compressed gas-containing cylinder which can store pressurized gas at pressures ranging from about 35 to 2,700 pounds per square inch (p.s.i.).

Such gas-containing cylinders typically include a fluid-tight vessel body with a cavity therein. The vessel body has a tapered neck with an outlet located at one end thereof. The cylinder is composed of a metal material for durability and strength. The compressed gas-containing cylinder may be sealed with a plate crimped at an outlet end for providing safe storage and transport. In order to dispense the compressed gas in a controlled manner, a fluid dispensing apparatus is ordinarily employed. The neck of the cylinder is mated with the gas port of the apparatus where a connecting pin is adapted to pierce through the cylinder plate for releasing the gas contents therethrough.

Generally, there are two types of cylinders used in the industry: those having threads and those that are unthreaded. Unthreaded cylinders are the most common and economical. However, fluid dispensing apparatuses which utilize such unthreaded cylinders usually require an assembly for positioning the cylinder to provide a secure fluid connection. The assembly holds the cylinder neck in position against the port, and applies a sufficient force to the cylinder to drive the neck end into the connecting pin for puncturing the plate and forming a fluid connection therebetween. Fluid connections of this type are disadvantageous because the cylinder neck is simply press fitted into position against the port which can result in leaking of the fluid at the junction of the cylinder neck and port.

Threaded cylinders typically include narrow, tapered threads extending along the surface of the cylinder neck. The threads substantially improve the quality of the fluid seal in the connection and provide a fluid connection which is more resistant to shock and vibration as compared to unthreaded fluid connections. However, the narrow, tapered threads cost substantially more to fabricate, have relatively low wear resistance and thread strength, and require many screw-turns for adequate seating within the port. These and other limitations associated with such threaded cylinders have restricted their use.

It would be a significant advance in the art of threaded connectors to provide a threaded connecting assembly for use especially with a compressed fluid which overcomes many of the limitations associated with prior art threaded connectors. The threaded connecting assembly of the present invention is constructed in a cost efficient and effective manner having minimal parts while providing the benefits of high thread strength, high pressure durability, ease of use, high wear resistance, and rapid-sealing.

SUMMARY OF THE INVENTION

The present invention is generally directed to a threaded connecting assembly comprising:

a first threaded connecting member having a body portion, an end portion, a bore extending axially from the end portion enabling the passage of a fluid through the body portion, and a plurality of spaced apart three sided threads defining grooves therebetween projecting along an exterior surface of the body portion at the end portion; and a cap member having a plurality of complementary three sided threads adapted to mate with the plurality of the three sided threads of the first threaded connecting member by seating in the grooves, and an opening configured for engagement with the bore of the first threaded connecting member to provide a passageway for the flow of the fluid therebetween.

BRIEF DESCRIPTION OF THE DRAWINGS

The following drawings in which like reference characters indicate like parts are illustrative of embodiments of the invention and are not to be construed as limiting the invention as encompassed by the claims forming part of the application.

DETAILED DESCRIPTION OF THE INVENTION

The present invention is generally directed to a threaded connecting assembly designed and constructed in a manner that provides a durable, rapid-sealing fluid connection for safe, reliable passage of a pressurized fluid between two locations. The threaded connecting assembly is constructed with the advantage of low cost, long term dependability, and ease of use as desired by the consumer. In addition, the threaded connecting assembly may be constructed in a manner which permits passage of high pressure fluid including gas, liquid and combinations thereof. The cost effective and efficient manner by which the threads are constructed and by which the threaded connecting assembly can be implemented makes the connecting assembly especially suitable for a variety of industrial and consumer uses including, but not limited to, gas actuation assemblies of the type shown and described in U.S. Pat. Nos. 5,458,165 and 5,566,730.

While this invention is being described in its preferred embodiment as being adaptable for use with compressed gas-containing cylinders and gas dispensing apparatuses, it will be understood that the invention may be utilized with other kinds of fluid delivering devices or conduits which require a threaded connection means for effecting movement of a fluid including gas, liquid and combinations thereof, from one location to another. It will also be understood that the invention has application for any environment and purpose particularly where it is desirable to create a durable, rapid-sealing fluid connection between two or more fluid delivering devices or conduits.

Figure 1:
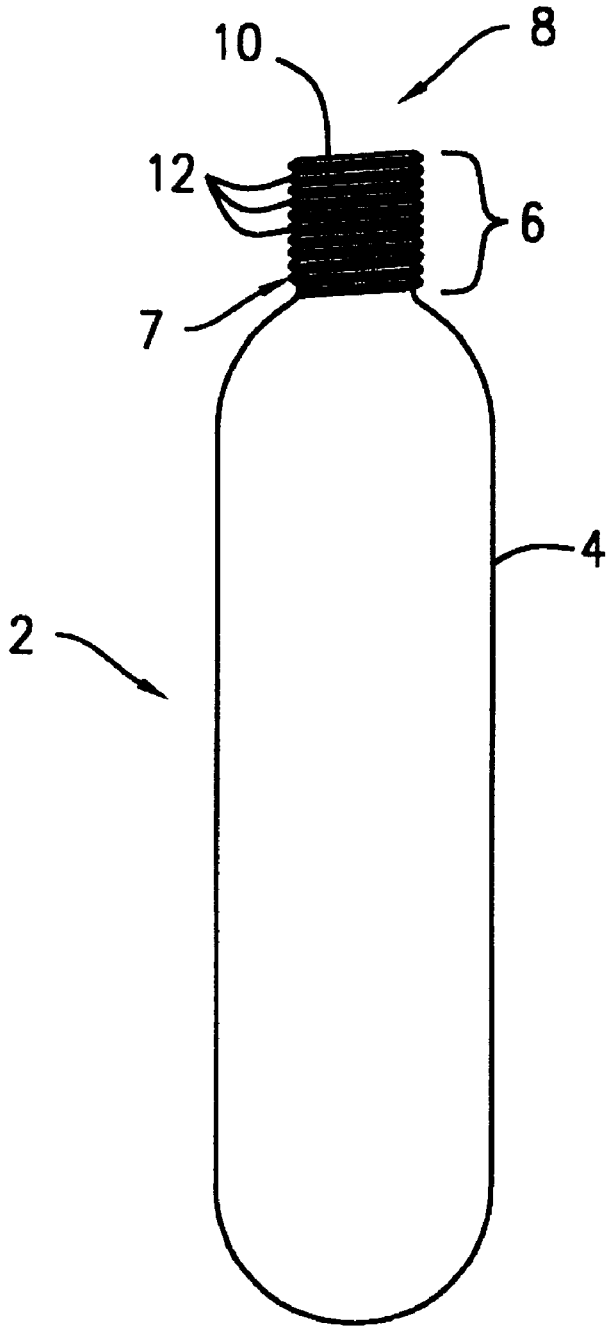
(PRIOR ART) FIG. 1
FIG. 1 is an elevational view of a prior art device including a compressed gas-containing cylinder and a conventional threaded connector for forming a threaded connecting assembly of the prior art.

Referring to FIG. 1, a compressed gas-containing cylinder 2 of the prior art is shown. The cylinder 2 includes a storage vessel 4 for storing a fixed volume of a compressed gas, and a first threaded connector 6 positioned in the neck 7 of the cylinder 2 for coupling with a second threaded connector or gas port of a gas dispensing apparatus as will be described hereinafter. It will be understood that the first threaded connector 6 may be located in other positions of the cylinder 2, not just the neck 7. The first threaded connector 6 includes an opening (not shown) at the top 8 thereof which is sealed by a plate 10 to secure the containment of compressed gas therein during storage and transport. The first threaded connector 6 further includes a plurality of narrow, triangularly-shaped and spaced exterior threads 12 separated by correspondingly shaped grooves 5 (see FIG. 3) extending therearound. The threads 12 of the prior art are 2 sided threads in that their opposed tapered sides meet at a point or tip portion 13 as shown best in FIG. 3.

Figure 2:
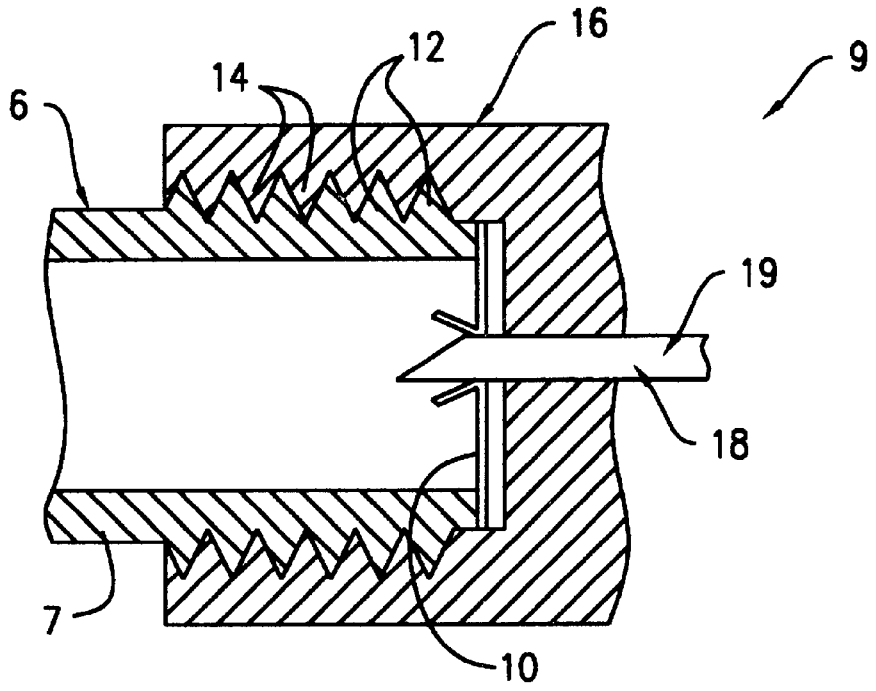
(PRIOR ART) FIG. 2
FIG. 2 is a partial cross sectional view of the prior art threaded connecting assembly utilizing the prior art device shown in FIG. 1.

Referring now to FIG. 2, the first threaded connector 6 is coupled to a gas port 16 by the mating engagement between the respective threads, 12 and 14 which seat within the grooves 5 to form a prior art threaded fluid connector assembly 9. The first threaded connector 6 must be screw-turned for six or more turns to achieve full seating within the port 16.

The gas port 16 includes a centrally located hollow connecting pin 18with a bore 19. The hollow connecting pin 18 is configured to pierce through the plate 10 as the first threaded connector 6 becomes seated within the port 16. Upon piercing the plate 10, the compressed gas within the cylinder 2 is discharged through the bore 19 of the hollow connecting pin 18 and into the gas dispensing apparatus (not shown). During such fluid connections, the engaged threads experience substantial shearing forces generated by the high pressured gas contained therein. With prolonged and repeated use, the 2 sided threads 12 and 14 are prone to cracking under pressure resulting in the failure of the fluid connection and consequential leaking of the stored fluid. In addition, the threads 12 and 14 possess limited wear resistance thus increasing the rate of connection failures after repeated use.

Figure 3:
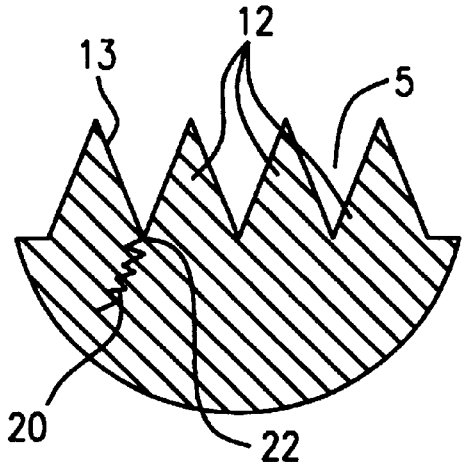
(PRIOR ART) FIG. 3
FIG. 3 is a cross sectional view of a portion of the first threaded connector threads of the prior art device of FIG. 1 for illustrating the prior art thread pattern.

With reference to FIG. 3, a sectional view of a portion of the 2 sided threads 12 of the first connector 6 is shown. The threads 12 include corner portions 22 which lie at the base of the respective threads 12. The threads 12 are vulnerable to stress fractures especially at the corner portions 22 because the high shearing forces that are generated by the high pressure gas, are focused along the threads which over time may result in material fatigue and premature failure. Such stress fractures often bring about leakage of fluid and compromised cylinder retainment within the gas port 16. As previously indicated, each of the 2 sided threads 12 include a substantially narrow tip portion 13 which is prone to breakage during implementation of the fluid connection. The same limitations described above likewise pertain to the complementary threads 14 of the gas port 16 (see FIG. 2).

The present invention at least substantially reduces the occurrence of stress fractures by providing a connecting assembly which is less vulnerable to potentially damaging shearing forces. The present invention can be best understood by reference to FIGS. 4–8C, showing various embodiments of a threaded connecting assembly of the present invention.

Figure 4:
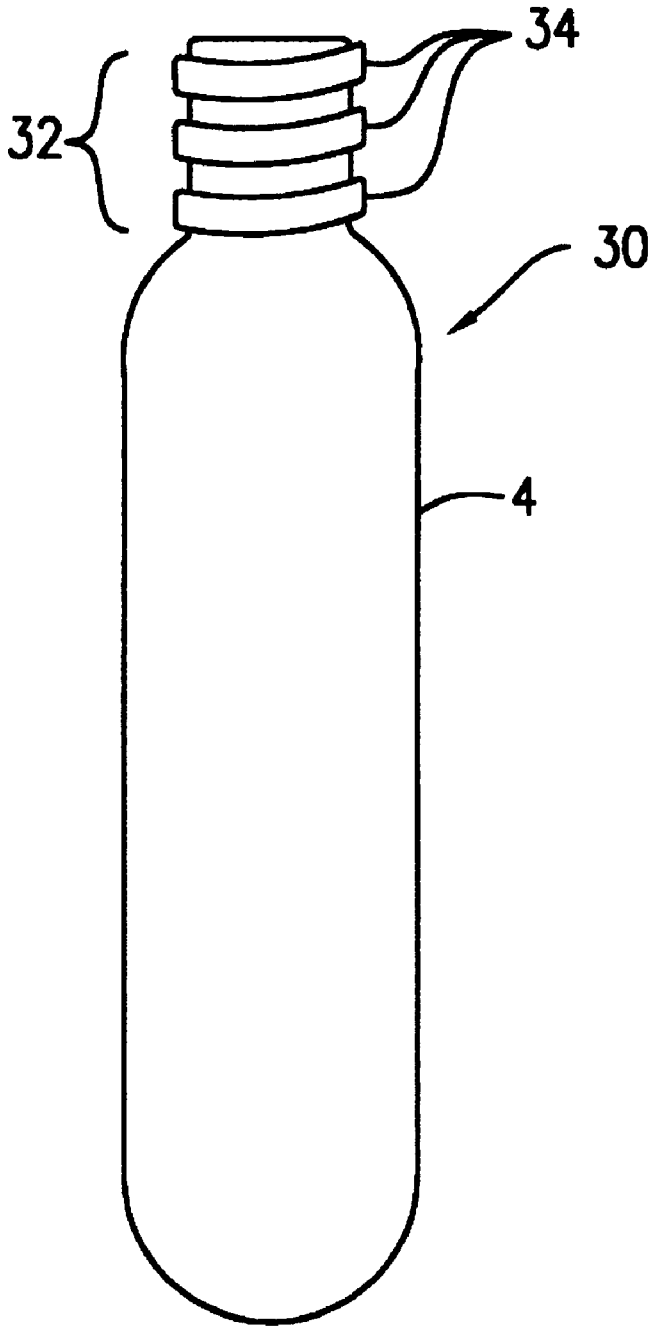
FIG. 4 is an elevational view of an embodiment of a device including a compressed gas-containing cylinder and a threaded connector for forming a threaded connecting assembly of the present invention.

Referring to FIG. 4, a compressed gas-containing cylinder 30 is provided with a first threaded connector 32 for establishing a threaded connecting assembly for one embodiment of the present invention. The cylinder 30 further includes a storage vessel 4 for storing a fixed quantity of a compressed fluid. By way of illustration only, the storage vessel 4 contains a compressed gas such as carbon dioxide, nitrogen, argon, helium and the like. A first threaded connector 32 is configured for threaded coupling with a second threaded connector in the form of a gas port 36 (see FIG. 5) and includes a plurality of exterior three sided threads 34 as defined herein, each having a broader profile than those found in the prior art connectors. It will be understood that the first threaded connector is shown at the neck region of the compressed gas containing cylinder but may be positioned at other regions as necessary to form a fluid connection therebetween. The term "3 sided thread" as used herein refers generally to the threads having three sides including an opposed pair of sides which may or may not be parallel to each other, connected to each other through a third side which may be straight or have one or more curvilinear portions.

The threads 34 are configured to withstand the shearing forces associated with high pressure fluid connections as will be described hereinafter. In a preferred embodiment particularly suited for connections of a compressed gas-containing cylinder to a gas actuator assembly similar to one shown in U.S. Pat. Nos. 5,458,165 and 5,566,730, the first threaded connector 32 is about ⅜" in length and about ⅜" in diameter. The threads 34 may number preferably from about two to four, and most preferably three. The width of each thread 34 is preferably about 1/16". In addition, the preferred embodiment has each of the threads 34 being separated by a 1/16" groove. The cylinder 30 may be adapted to retain a compressed gas at pressures ranging from about 35 to 2,700 pounds per square inch (p.s.i.). The cylinder 30 may be further composed of a suitable durable material such as steel, aluminum, plastic, carbon fiber composite, and the like for safe containment of the fluid contents therein.

Figure 5:
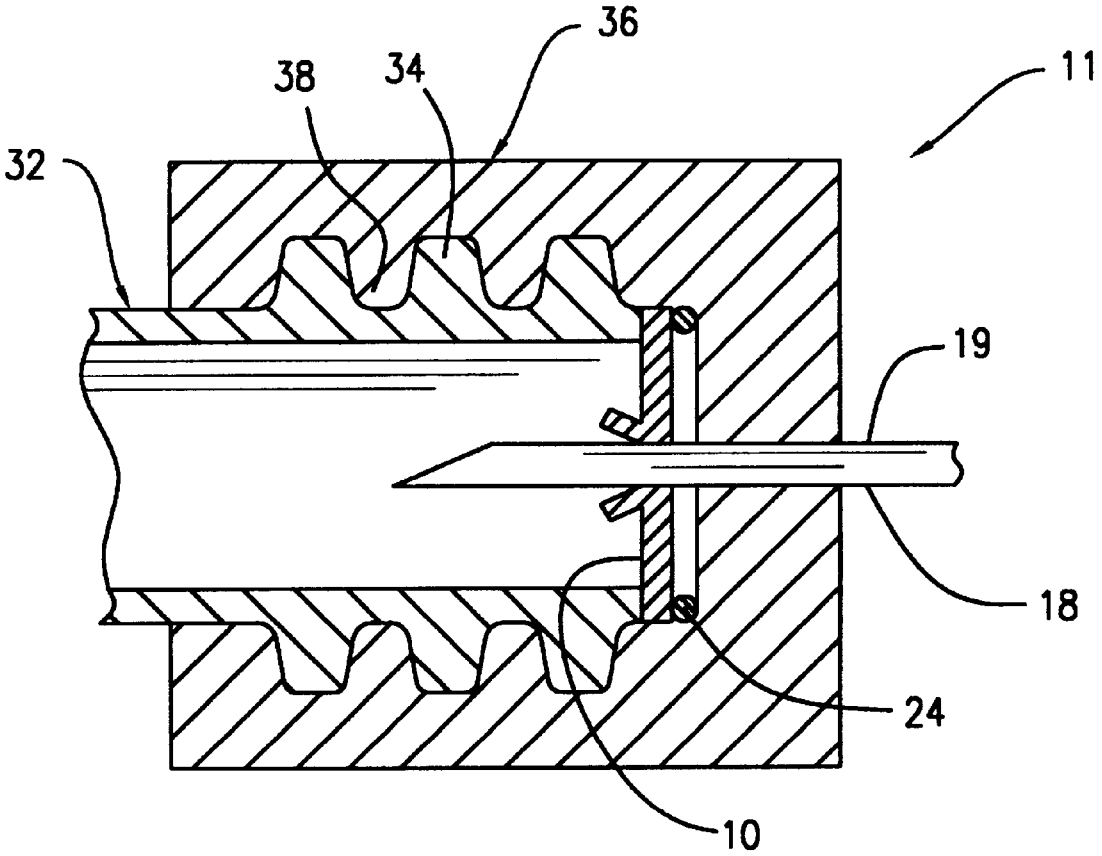
FIG. 5 is a partial cross sectional view of the a threaded connecting assembly of the present invention utilizing the device shown in FIG. 4.

Referring to FIG. 5, the present invention is shown generally as a threaded connection between two conduits enabling fluid passage therebetween. FIG. 5 is a cross sectional view through the engaged threaded connectors, and illustrate the first threaded connector 32 on the left and the second threaded connector in the form of the gas port 36 on the right. As shown, the first threaded connector 32 is formed with a plurality of exterior three sided threads 34 on the end thereof.

In accordance with the present invention, the external threads 34 are synchronized, such that rotating the first threaded connector 32 in a clockwise direction enables the external threads 34 to travel along and engage the mating threads on the gas port 36. In this regard, the gas port 36 includes a plurality of complementary interior threads 38 which are configured to engage with the exterior threads 34 of the first threaded connector 32 as the two threaded connectors are screw threaded together to form a threaded connecting assembly 11 of the present invention.

The threaded connecting assembly 11 may further optionally include an O-ring 24 in the gas port 36 for improving the quality of the fluid seal between the first threaded connector 32 and the gas port 36. The fluid seal may further be effected by sealing means other than O-rings, i.e. by any fluid seal design or type that is typical for the particular industry in which fluid connectors are utilized as for examples washers, TEFLON tapes, sealant substances, and the like.

Figure 6:
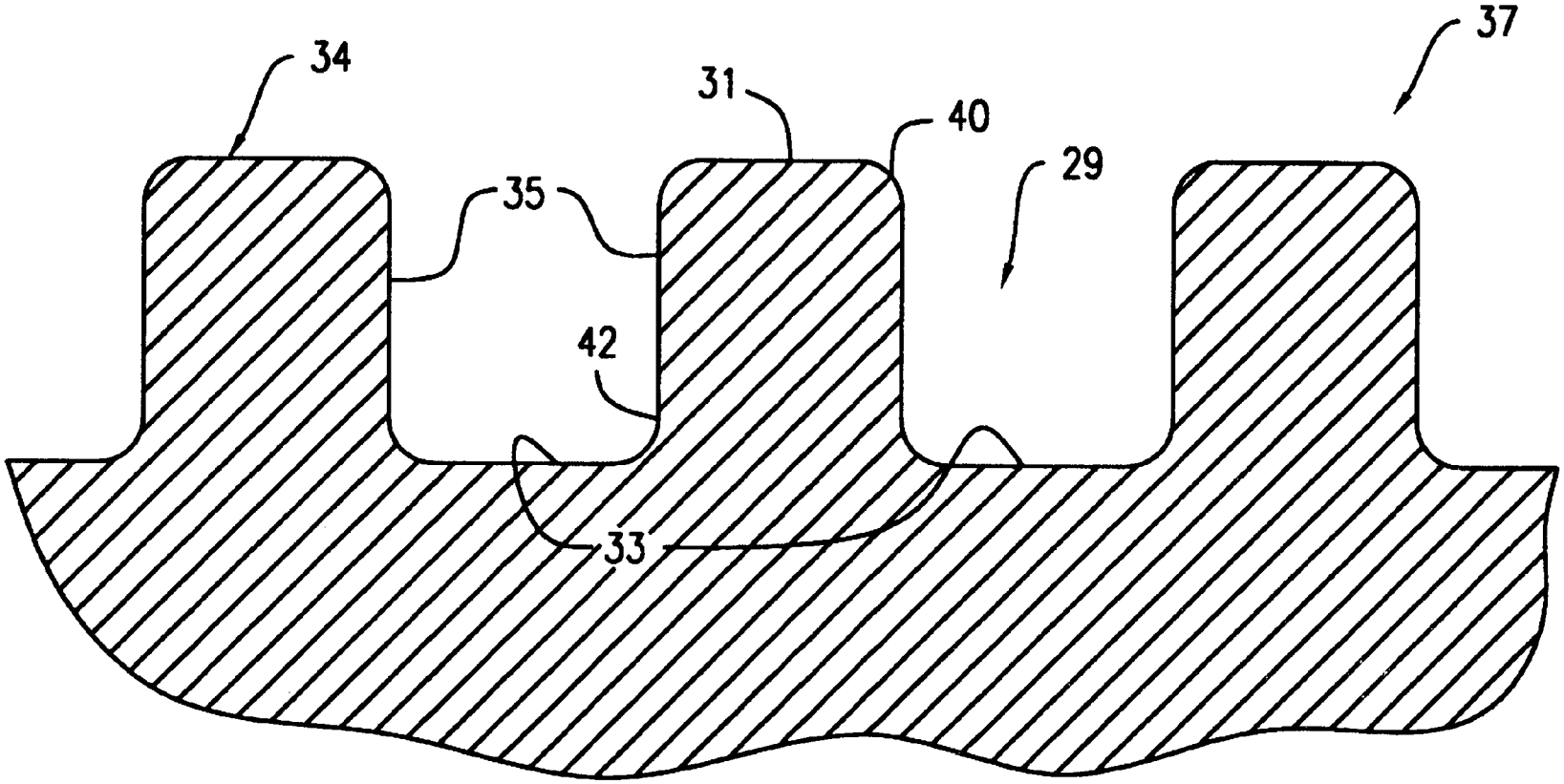
FIG. 6 is an exploded cross sectional view of the first threaded connector shown for illustrating a representative thread pattern of the threaded connecting assembly shown in FIG. 5.

Referring to FIG. 6, an exploded cross sectional view of the threads 34 of the first threaded connector 32 is shown for illustrating a representative thread pattern referred generally by reference numeral 37 of a plurality of three sided threads 34. The three sided threads 34 have a generally wider profile than 2 sided conventional threads for improved wear resistance and capacity to withstand shearing forces associated with high pressure fluid connections. Each of the three sided threads 34 includes a pair of opposed side portions 35 which may or may not be parallel to each other and connected together through a top portion 31 which may be flat or contain one or more curvilinear portions.

Each of the three sided threads 34 also includes corner portions 40 and 42 at areas where the side portions 35 meet with the top portions 31, and the side portions 35 meet with base portions 33 of the first threaded connector 32, respectively. The corner portions 40 and 42 are preferably curvilinear for minimizing stress fractures typically associated with sharp angular areas (i.e. perpendicular junction areas).

The three sided threads of the present invention provide the structural strength necessary to resist the shearing forces often encountered by the threaded connecting assembly 11 of the type shown in FIG. 5. The curvilinear corner portions 40 and 42 function to distribute at least a significant portion of the shearing forces over a larger surface area to effectively reduce the potential for the formation of stress fractures and improve the overall wear resistance of the three sided threads 34. The threads 34 further include grooves 29 including the base portion 33 for receiving the three sided threads 38 having a shape complementary to the shape of the three sided threads 34 to establish the threaded connecting assembly 11 of FIG. 5.

Due to improved structural strength and locking strength of the threads 34 and 38 (see FIG. 5), the number of threads necessary to secure the component parts of the threaded connecting assembly 11 together are reduced, typically to about two to four, preferably to three. A reduction in the number of threads in accordance with the present invention, reduces the number of screw-turns required to fully seat the first threaded connector 32 into the gas port 36. The first threaded connector 32 is fully seated within the gas port 36 after about two to four, and preferably about three screw-turns. The rapid seating provides a quick fluid connection with minimal initial leakage of compressed gas from the threaded connecting assembly 11, and further provides ergonomic convenience to the user especially to those who may suffer from arthritis or other disabilities associated with loss of manual dexterity.

Figure 7:
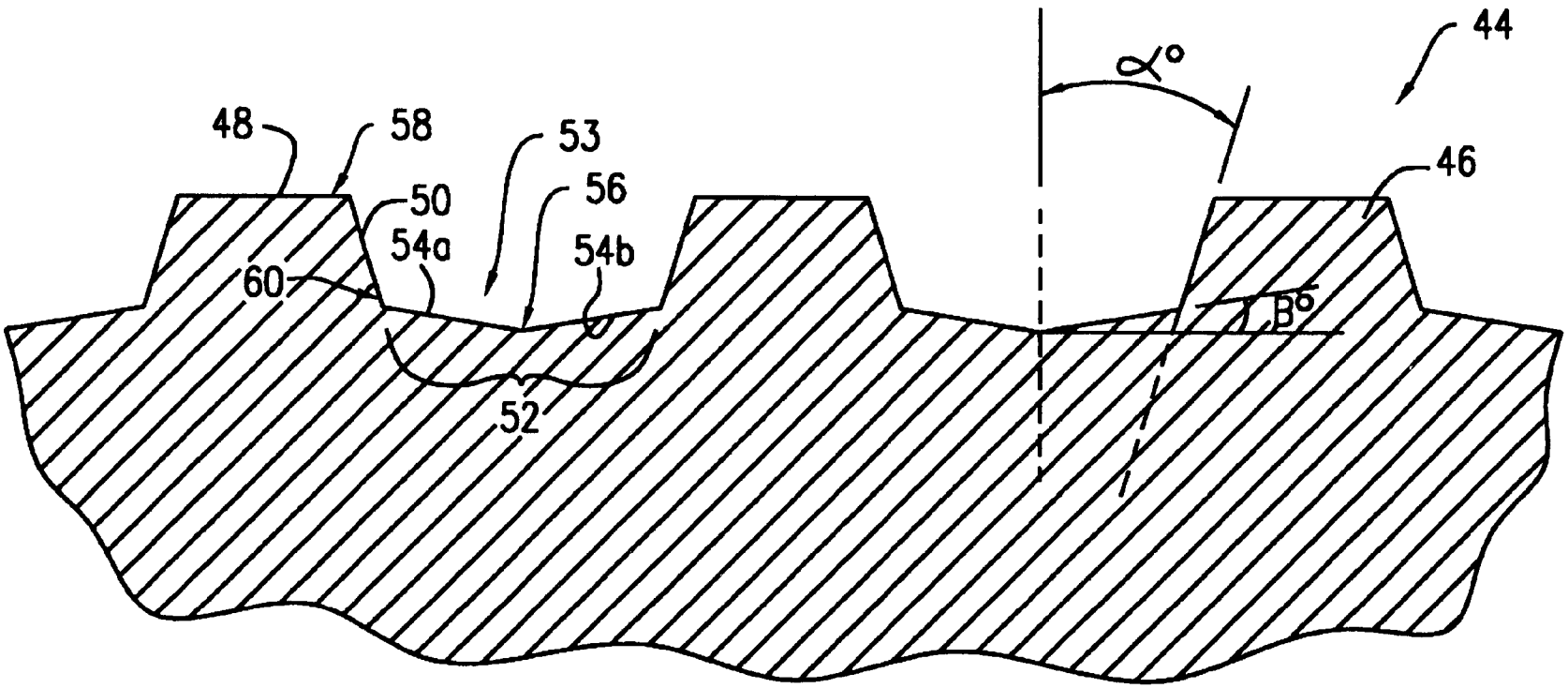
FIG. 7 is an exploded cross sectional view of the first threaded connector illustrating a thread pattern for a second embodiment of the present invention.

Referring to FIG. 7, an exploded cross sectional view of the first threaded connector 32 illustrating a thread pattern 44 for a second embodiment of the present invention is shown. It will be understood that the corresponding gas port 36 of the threaded connecting assembly 11 for the second embodiment includes a complementary thread pattern which is synchronized with the thread pattern 44 as shown, such that a secure threaded engagement is achieved therebetween.

The three sided thread pattern 44 of the first threaded connector 32 includes a plurality of spaced apart three sided threads 46, each having a flat top portion 48 and a pair of opposed sloping side portions 50 having grooves therebetween including respective base portions 52. The sloping side portions 50 are oriented at an angle a measured from the vertical axis. The angle a is preferably within the range of from about 10° to 20°, and more preferably at about 15°.

The base portion 52, located between respective side portions 50, includes two or more of angled surfaces (two angle surfaces 54*a* and 54*b* are shown). Each of the surfaces 54*a* and 54*b* is slanted upwardly from a common point 56 to the respective side portion 50 at an angle β measured from the horizontal axis. The angle β is preferably within the range from about 6° to 18°, more preferably within the range of from about 10° to 14°, and most preferably at about 12°. The adjacent surfaces 54*a* and 54*b* in combination, form a groove 53 therebetween for receiving the complementarily shaped three sided threads of the corresponding gas port 36 as the two connectors are threadedly fastened to one another. During manufacturing, the configuration of the groove 53 serves to facilitate the removal of excess waste material formed between the threads 46 during the thread cutting process.

The profile of the three sided threads 46 provides the structural strength necessary to withstand the shearing forces associated with prolonged and repeated use. The sloping side portions 50 and the flat top portion 48 of the three sided thread 46, in combination forms an outside corner 58 on each side thereof. The sloping side portion 50 and the corresponding angled surfaces 54*a*, 54*b* of the thread 46, in combination form an inside corner 60 on each side thereof. The side portion 50 and the corresponding surface 54*a* or 54*b*, are oriented at the angles α and β respectively, to form two facets for effectively distributing the shearing force in two directions through the material rather than concentrating the shearing in one area or region as observed in the prior art threaded fluid connection 9 of FIGS. 1–3.

Figure 8B:
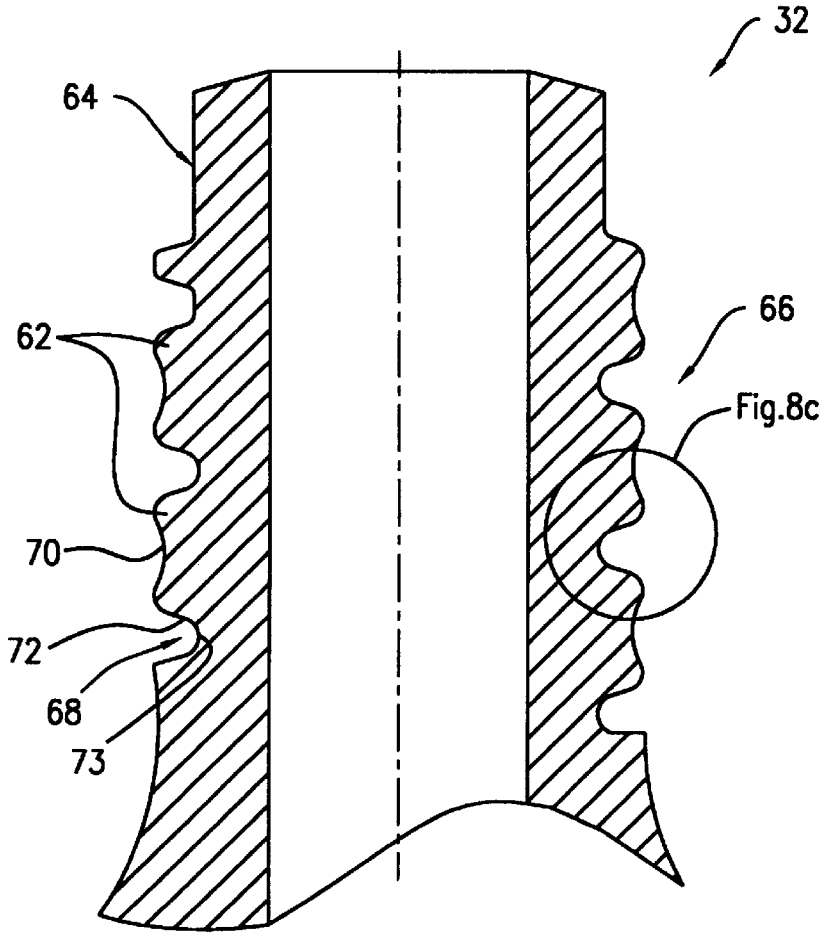
FIG. 8B is an exploded cross sectional view of the first threaded connector of the compressed gas-containing cylinder shown in FIG. 8A.
Figure 8A:
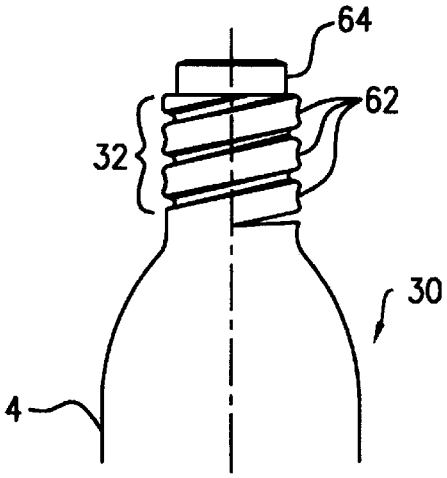
FIG. 8A is partial side elevational view of the first threaded connector of a device for a third embodiment of the present invention in the form of a compressed gas-containing cylinder.

Referring to FIG. 8A, the first threaded connector 32 is shown on the gas-containing cylinder 30 to establish the threaded connecting assembly 11 for a third embodiment of the present invention. The first threaded connector 32 includes a plurality of three sided threads 62 configured for threaded coupling with a gas port (not shown) having a complementary set of three sided threads for forming the threaded connecting assembly 11 of the present invention. In this embodiment, the first threaded connector 32 further includes a nose section 64 at an end thereof. The nose section 64 facilitates the seating of the first threaded connector 32 into the gas port 36 and onto the O-ring or gasket located therein for improved ease of use and better quality gas seal.

Figure 8C:
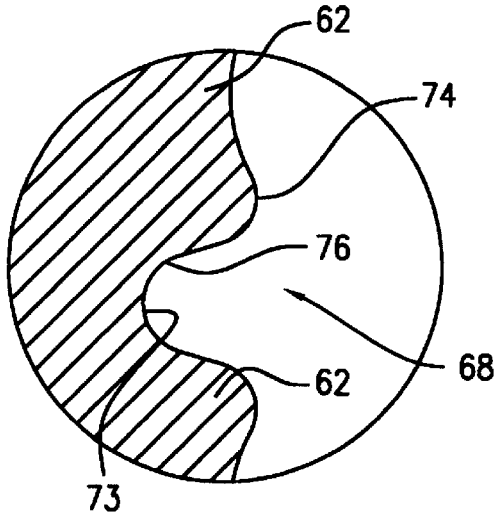
FIG. 8C is an enlarged detailed cross sectional view of a portion of the first threaded connector as indicated by a circle marked "FIG. 8C" in FIG. 8B.

With reference to FIG. 8B, an exploded cross sectional view of a thread pattern referred generally by the reference numeral 66 of the first threaded connector 32 is shown. The three sided threads 62 include a narrow groove 68 with a flat horizontal base portion 73 disposed therebetween for receiving the complementarily shaped threads of the corresponding gas port 36. Each thread 62 is provided with a top surface 70 having a curvilinear portion and substantially vertical side portions 72 which in combination establish a desirable profile for improved wear resistance and resistance to shearing forces associated with high pressure fluid connections. With reference to FIG. 8C, the thread 62 further includes corner portions 74 and 76 having a curvilinear shape. As described above, the curvilinear corner portions 74 and 76 resist stress fractures by uniformly distributing the shearing forces over the total surface of the corner portions 74 and 76 rather at select focused points as observed in prior art threaded connections. In this embodiment of the invention, the threads are press-formed by a metal rolling technique whereby the metal material is effectively shifted by pressure to form the corresponding threads and groove. Accordingly, the corner portion 74 includes a slight bulge caused by the displacement of the metal from the groove 68.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A portable apparatus for passing a compressed fluid to a vessel comprising:

a) a first vessel for receiving the compressed fluid;

b) a compressed gas-containing vessel for storing the compressed fluid; and c) a threaded connecting assembly for fluidly connecting the first and second vessels to establish a fluid passage therebetween and to enable the compressed gas-containing vessel to be rotated into and out of sealable engagement with the first vessel, said threaded connecting assembly comprising:

a first threaded connecting member having a body portion, an end portion, a bore extending axially from the end portion enabling the passage of a fluid therethrough, and from 2 to 4 spaced apart three sided threads defining grooves therebetween projecting along an exterior surface of the body portion at the end portion; and a cap member comprising a plurality of complementary three sided threads adapted to mate with the from 2 to 4 three sided threads of the first threaded connecting member by seating in said grooves, and an opening configured for engagement with said bore of the first threaded connecting member to provide a passageway for the flow of the fluid therebetween.

2. The apparatus of claim 1, wherein the body portion of the threaded connecting assembly is substantially cylindrical and includes a substantially flat base portion disposed between adjacent threads of the first threaded connecting member and between adjacent threads of the cap member.

3. The apparatus of claim 1, wherein each of said first threaded connecting member and cap member threads, further comprises:

a substantially flat top portion; and a pair of side portions, each extending from said top portion to said base portion on each side of said thread.

4. The apparatus of claim 3, wherein the width of the base portion and the top portion are the same.

5. The apparatus of claim 1, wherein each of said first threaded connecting member and cap member threads, further comprises:

a pair of curvilinear outside corners, each disposed along a joint area between said top and side portions; and a pair of curvilinear inside corners, each disposed along a joint area between said base and side portions.

6. The apparatus of claim 1, each of said first threaded connecting member and cap member threads is about 1/16 of an inch wide.

7. The apparatus of claim 1, wherein said first threaded connecting member has a length and diameter of about 3/8 of an inch.

8. The apparatus of claim 1, further comprising sealing means for fluidly sealing said first threaded connecting member and said cap member.

* * * * *